US008850732B2

(12) United States Patent
Zheng

(10) Patent No.: US 8,850,732 B2
(45) Date of Patent: Oct. 7, 2014

(54) MAGAZINE SHELL OF A UNIVERSAL MAGAZINE OF MULTIPLE CALIBER COMPATIBILITY FOR FIREARMS

(71) Applicant: Jing Zheng, El Paso, TX (US)

(72) Inventor: Jing Zheng, El Paso, TX (US)

( * ) Notice: Subject to any disclaimer, the term of this patent is extended or adjusted under 35 U.S.C. 154(b) by 0 days.

(21) Appl. No.: 13/731,089

(22) Filed: Dec. 30, 2012

(65) Prior Publication Data

US 2013/0167421 A1 Jul. 4, 2013

Related U.S. Application Data

(60) Provisional application No. 61/582,205, filed on Dec. 30, 2011.

(51) Int. Cl.
*F41A 9/70* (2006.01)
*F41A 9/71* (2006.01)

(52) U.S. Cl.
CPC ..... *F41A 9/70* (2013.01)
USPC ..... 42/50; 42/49.02

(58) Field of Classification Search
USPC ..... 42/49.01, 49.02, 50
See application file for complete search history.

(56) References Cited

U.S. PATENT DOCUMENTS

| | | | | | |
|---|---|---|---|---|---|
| 1,500,580 | A * | 7/1924 | Fererro | 42/50 |
| 3,019,542 | A * | 2/1962 | Manthos | 42/18 |
| 3,732,643 | A * | 5/1973 | Wells | 42/50 |
| 4,589,218 | A * | 5/1986 | Teppa | 42/50 |
| 5,113,605 | A * | 5/1992 | Kim | 42/50 |
| 5,704,148 | A * | 1/1998 | Valorose | 42/50 |
| 8,028,455 | B1 * | 10/2011 | Battaglia | 42/49.02 |
| 2003/0046850 | A1 * | 3/2003 | Beretta | 42/50 |
| 2010/0281737 | A1 * | 11/2010 | Cahill | 42/50 |
| 2012/0167429 | A1 * | 7/2012 | Sullivan | 42/50 |

* cited by examiner

*Primary Examiner* — Bret Hayes
(74) *Attorney, Agent, or Firm* — Han IP Corporation; Andy M. Han

(57) ABSTRACT

A magazine for a firearm comprises a magazine shell and a main magazine spring. The magazine shell includes a first end, a second end opposite the first end, and sidewalls between the first end and the second end. The first end includes an opening and is configured to attach to the firearm. The second end includes a bottom plate. The main magazine spring includes a first end and a second end opposite the first end. The second end of the main magazine spring is coupled to the bottom plate of the second end of the magazine shell.

13 Claims, 16 Drawing Sheets

MAGAZINE SHELL OF A UNIVERSAL MAGAZINE OF MULTIPLE CALIBER COMPATIBILITY FOR FIREARMS

CROSS-REFERENCE TO RELATED APPLICATIONS

This application claims the priority benefit of U.S. Patent Application No. 61/582,205, entitled "A Universal Magazine of Multiple Caliber Compatibility for Firearms" and filed on Dec. 30, 2011. The entirety of the above-identified patent application is hereby incorporated by reference and made a part of this specification.

BACKGROUND

1. Technical Field

The present disclosure generally relates to firearms. More specifically, the present disclosure relates to a magazine for firearms.

2. Description of Related Art

In the context of firearms, a magazine is an ammunition storage and feeding device within or attached to a repeating firearm. The magazine functions by moving the ammunition cartridges stored in the magazine into a position where the cartridges are loaded into the chamber of the firearm. In order for fresh rounds of ammunition to be reloaded to the firearm reliably, each ammunition cartridge needs to be in a specific angle and position aligned with the firearm barrel so that it can be rammed into the barrel by the firearm action devices, e.g., the rifle bolt or handgun slides. To ensure such feeding process proceeds smoothly, the firearm magazine is designed to provide each round of ammunition with full support within the magazine. FIG. 3 illustrates a prior art firearm magazine 10. As shown in FIG. 3, a spring inside the magazine pushes the ammunition against the magazine lip 11 securely so that the ammunition will align axially with the barrel at the designed angle and position.

For the ease of ejection after firing, ammunition cartridges, especially rifle cartridges, have various tapering design on the casing. Due to the material used for the casing, some ammunition cartridges have larger tapering angle than others. There is one dubbed as 7.62×39, also known as M43 or 762 Russian, which has one of the largest case tapering. Another popular caliber, which is dubbed as 223 Remington, has one of the smallest case tapering. FIG. 4 illustrates an M43 ammunition 20. FIG. 5 illustrates a 223 Remington ammunition 30. As shown in FIGS. 4 and 5, the casing 22 of the M43 ammunition 20 and the casing 32 of the 223 Remington ammunition 30 have different tapering angles. FIG. 6 illustrates how the M43 ammunition cartridges are stacked inside a magazine in order to maintain full support of each ammunition cartridge. FIG. 7 illustrates how the 223 Remington ammunition cartridges are stacked inside a magazine in order to maintain full support of each ammunition cartridge. As shown in FIGS. 6 and 7, given the tapering angle of the casing, the stack of M43 ammunition cartridges and the stack of 223 Remington ammunition cartridges appear to have a "bent" shape although the stack of M43 ammunition cartridges has a more pronounced "bent" shape given the relatively larger tapering angle of the M43 ammunition casing. Accordingly, the design of the magazine may need to adopt the "bent" shape. FIG. 8 illustrates an AK style magazine that is a banana shaped magazine. There is, however, one disadvantage associated with the kind magazine as that shown in FIG. 8. As the whole magazine has a banana shape, it has to be mounted onto a firearm with a rotational action. As a result, it is not easy to drop such a magazine by its own weight when the magazine is empty.

On the contrary, rifles such as AR15 use a STANAG magazine that utilizes a straight-bent-straight design so that the end that has the feeding lip has a straight potion and can be inserted into the rifle's straight magazine wall. FIG. 9 illustrates such a STANAG magazine. When the magazine catch is released, the magazine can be dropped out of the rifle by its own weight. This allows the firearm operator to insert a loaded magazine back into the firearm with relatively less time compared to the case with the AK47 style magazine. Although the time difference may be seconds or fractions of a second, such time difference could mean a difference of life and death in the battle field.

However, such straight-bent-straight design has problems. One problem is that ammunition cartridges of different calibers have different rim diameters (the diameter of the casing near the bottom area, where the diameter is the biggest, which is called "rim").

To stack the ammunition cartridges efficiently inside of the magazine, the ammo should be staged in the way shown in FIG. 10. This way, the ammunition cartridge is supported by the interior of the magazine groove, and by each other ammunition cartridge, tightly. However, for ammunition cartridges of other calibers having a smaller rim diameter, the minimum distance between the groove interior may not be able to support each cartridge and the support between each cartridge is no longer certain. FIG. 11 shows one of the possible positional relationships between each cartridge. Compared to what is shown in FIG. 10, the relative position of ammunition cartridges between each other inside the magazine wall can be altered. FIG. 12 shows another possibility of ammunition cartridge stacked inside of the magazine, which is a non-stable scenario. Movement of the magazine during the usage will likely shift the ammunition inside to other configurations. Such shifting may cause jam of the ammunition, and/or other malfunctions, during firing. For example, when ammunition cartridges with a smaller rim diameter are stacked in the magazine that is suitable for large rim diameters, as shown in FIG. 11, the ammunition cartridges may jump out of the magazine lip by themselves, due to the uncertain forces acted on each individual ammunition cartridge. This not only affects the reliable storage function of the magazine, it will also introduce jam that is hard to be cleared.

As AR15 rifles are among the most popular rifles in the civilian market, ammunition cartridges of different calibers are available for the AR15 rifles. Consequently, ammunition cartridges with casings of various tapering angles and rim diameters have to cope with the straight magazine wall design of the AR15 rifle.

SUMMARY

The present disclosure is directed to a magazine shell of a universal magazine with multiple caliber compatibility and straight magazine wall.

According to one aspect, a magazine for a firearm may comprise a magazine shell, a follower (or follower assembly), a bottom plate, and a main magazine spring. The magazine shell may include a first end, a second end opposite the first end, and sidewalls between the first end and the second end. The first end may have an opening and configured to attach to the firearm. The second end may be configured to hold or include a bottom plate. The main magazine spring may include a first end and a second end opposite the first end. The second end of the main magazine spring may be coupled to the bottom plate of the second end of the magazine shell. The magazine may comprise either a follower or a follower assembly, disposed inside the magazine shell, which may be movable generally along a longitudinal axis of the magazine shell.

In at least one embodiment, the magazine shell may include at least one reinforcement groove having a plurality of sections thereof. A cross-sectional diameter of a first section of the plurality of sections of the at least one reinforcement groove may be different from a cross-sectional diameter of a second section of the plurality of sections of the at least one reinforcement groove.

In at least one embodiment, the magazine shell may include a first reinforcement groove on a first primary side of the magazine shell. The magazine shell may further include a second reinforcement groove on a second primary side of the magazine shell opposite to the first primary side. Variations in the cross-sectional diameter of each of the first and the second reinforcement grooves may render a distance between an inner surface of the first primary side and an inner surface of the second primary side to generally decrease as viewed in a direction from the second end toward the first end of the magazine shell.

The universal magazine may further comprise a deformable magazine sidewall spring. The deformable magazine sidewall spring may be received in the magazine shell and fitted along an internal surface of the magazine shell. The deformable magazine sidewall spring may provide side support to one or more ammunition cartridges when the one or more ammunition cartridges are held in the magazine shell and in contact with the deformable magazine sidewall spring by deforming and exerting a third force on the one or more ammunition cartridges in directions generally perpendicular to the sidewalls of the magazine shell.

In at least one embodiment, the deformable magazine sidewall spring may comprise a thin sheet metal.

In at least one embodiment, the deformable magazine sidewall spring may have an outer surface contoured to match an inner surface of the sidewalls of the magazine shell. The sidewalls of the magazine shell may include one or more reinforcement grooves. The deformable magazine sidewall spring may include one or more grooves corresponding to the one or more reinforcement grooves of the magazine shell. The one or more grooves of the deformable magazine sidewall spring may provide side support to one or more ammunition cartridges when the one or more ammunition cartridges are held in the magazine shell.

In at least one embodiment, the deformable magazine sidewall spring may include a protrusion that extends outside the magazine shell and contacts an external surface of the magazine shell when the deformable magazine sidewall spring is received in the magazine shell. The protrusion may reinforce sealing between the deformable magazine sidewall spring and the magazine shell.

In at least one embodiment, the deformable magazine sidewall spring may include a protrusion that extends into a feeding lip of the magazine shell and forms a bump a ridgeline of which is generally parallel with a ridgeline of the feeding lip of the magazine shell. The bump may provide guidance support to one or more ammunition cartridges of different calibers when the one or more ammunition cartridges are pushed out of the magazine shell and into a firing chamber of the firearm by a bolt of the firearm.

According to another aspect, a magazine for a firearm may comprise a magazine shell, a bottom plate, a main magazine spring, a follower or follower assembly, and a deformable magazine sidewall spring. The magazine shell may have a first end, a second end opposite the first end, and sidewalls between the first end and the second end. The first end may have an opening and configured to attach to the firearm. The second end may be configured to hold or include a bottom plate. The main magazine spring may include a first end and a second end opposite the first end. The second end of the main magazine spring may be coupled to the bottom plate of the second end of the magazine shell. The deformable magazine sidewall spring may be received in the magazine shell and fitted along an internal surface of the magazine shell. The deformable magazine sidewall spring may provide side support to one or more ammunition cartridges when the one or more ammunition cartridges are held in the magazine shell and in contact with the deformable magazine sidewall spring by deforming and exerting a third force on the one or more ammunition cartridges in directions generally perpendicular to the sidewalls of the magazine shell. Such third force may vary depending on ammunition cartridges with different rim diameters. The magazine may comprise a follower or a follower assembly, disposed inside the magazine shell, which may be movable generally along a longitudinal axis of the magazine shell.

In at least one embodiment, the deformable magazine sidewall spring may comprise a thin sheet metal.

In at least one embodiment, the deformable magazine sidewall spring may have an outer surface contoured to match an inner surface of the sidewalls of the magazine shell.

In at least one embodiment, at least a first sidewall of the sidewalls of the magazine shell may include at least one reinforcement groove having a plurality of sections thereof. A cross-sectional diameter of a first section of the plurality of sections of the at least one reinforcement groove may be different from a cross-sectional diameter of a second section of the plurality of sections of the at least one reinforcement groove.

In at least one embodiment, the magazine shell may include a first reinforcement groove on a first primary side of the magazine shell. The magazine shell may further include a second reinforcement groove on a second primary side of the magazine shell opposite to the first primary side. Variations in the cross-sectional diameter of each of the first and the second reinforcement grooves may render a distance between an inner surface of the first primary side and an inner surface of the second primary side to generally decrease as viewed in a direction from the second end toward the first end of the magazine shell.

In at least one embodiment, the deformable magazine sidewall spring may include at least one groove corresponding to the at least one reinforcement groove of the magazine shell. The at least one groove of the deformable magazine sidewall spring may provide side support to one or more ammunition cartridges when the one or more ammunition cartridges are held in the magazine shell.

In at least one embodiment, the deformable magazine sidewall spring may include a protrusion that extends outside the magazine shell and contacts an external surface of the magazine shell when the deformable magazine sidewall spring is received in the magazine shell. The protrusion may reinforce sealing between the deformable magazine sidewall spring and the magazine shell.

In at least one embodiment, the deformable magazine sidewall spring may include a protrusion that extends into a feeding lip of the magazine shell and forms a bump a ridgeline of which is generally parallel with a ridgeline of the feeding lip of the magazine shell. The bump may provide guidance support to one or more ammunition cartridges of different calibers when the one or more ammunition cartridges are pushed out of the magazine shell and into a firing chamber of the firearm by a bolt of the firearm.

BRIEF DESCRIPTION OF THE DRAWINGS

The accompanying drawings are included to provide a further understanding of the disclosure, and are incorporated in and constitute a part of the present disclosure. The drawings illustrate embodiments of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF THE PREFERRED EMBODIMENTS

Overview

Figure 1:
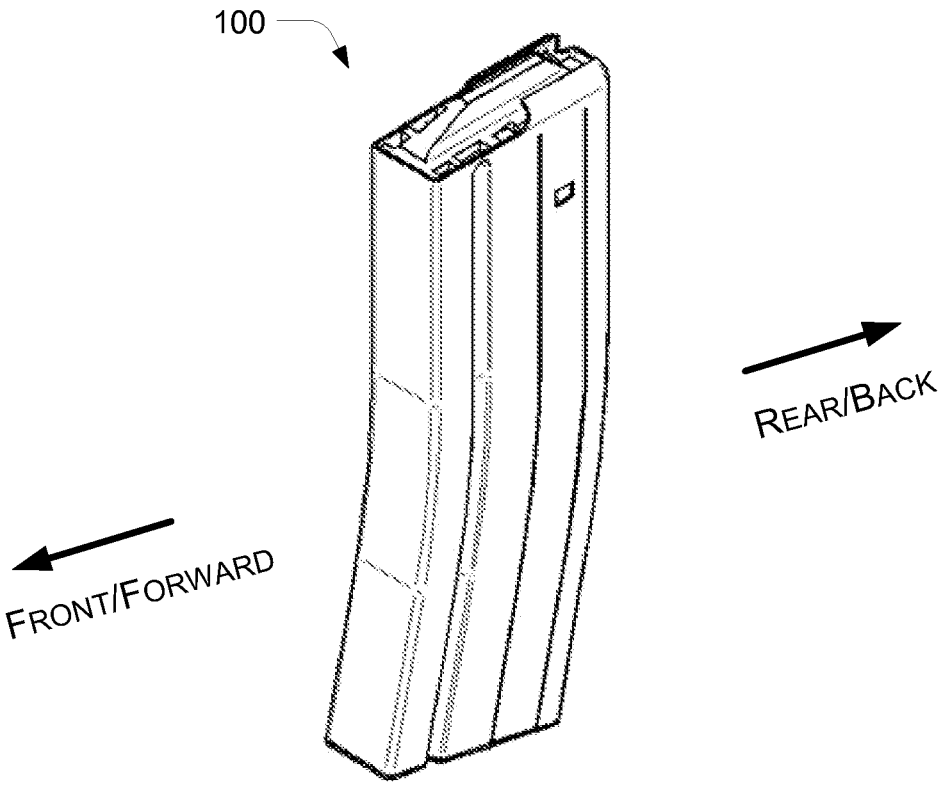
FIG. 1 is an assembly view of a universal magazine in accordance with an embodiment of the present disclosure.

Various embodiments of the present disclosure relate to a universal magazine shell for firearms, such as rifles, that have straight magazine wall. The universal magazine can accommodate ammunition cartridges of various calibers. More specifically, the universal magazine can reliably feed ammunition cartridges into a rifle chamber regardless of the caliber of the ammunition cartridges as long as the ammunition cartridges can fit in the universal magazine. The universal magazine may include a universal magazine shell and a self-adjusting deformable magazine sidewall spring. Alternatively, the universal magazine may include a universal magazine shell without the self-adjusting deformable magazine sidewall spring.

Reference will now be made in detail to the preferred embodiments of the present disclosure, examples of which are illustrated in the accompanying drawings. Wherever possible, the same reference numbers are used in the drawings and the description to refer to the same or like parts.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator of the firearm. The same convention applies for the direction statements used herein.

Example Universal Magazine

Figure 2A:
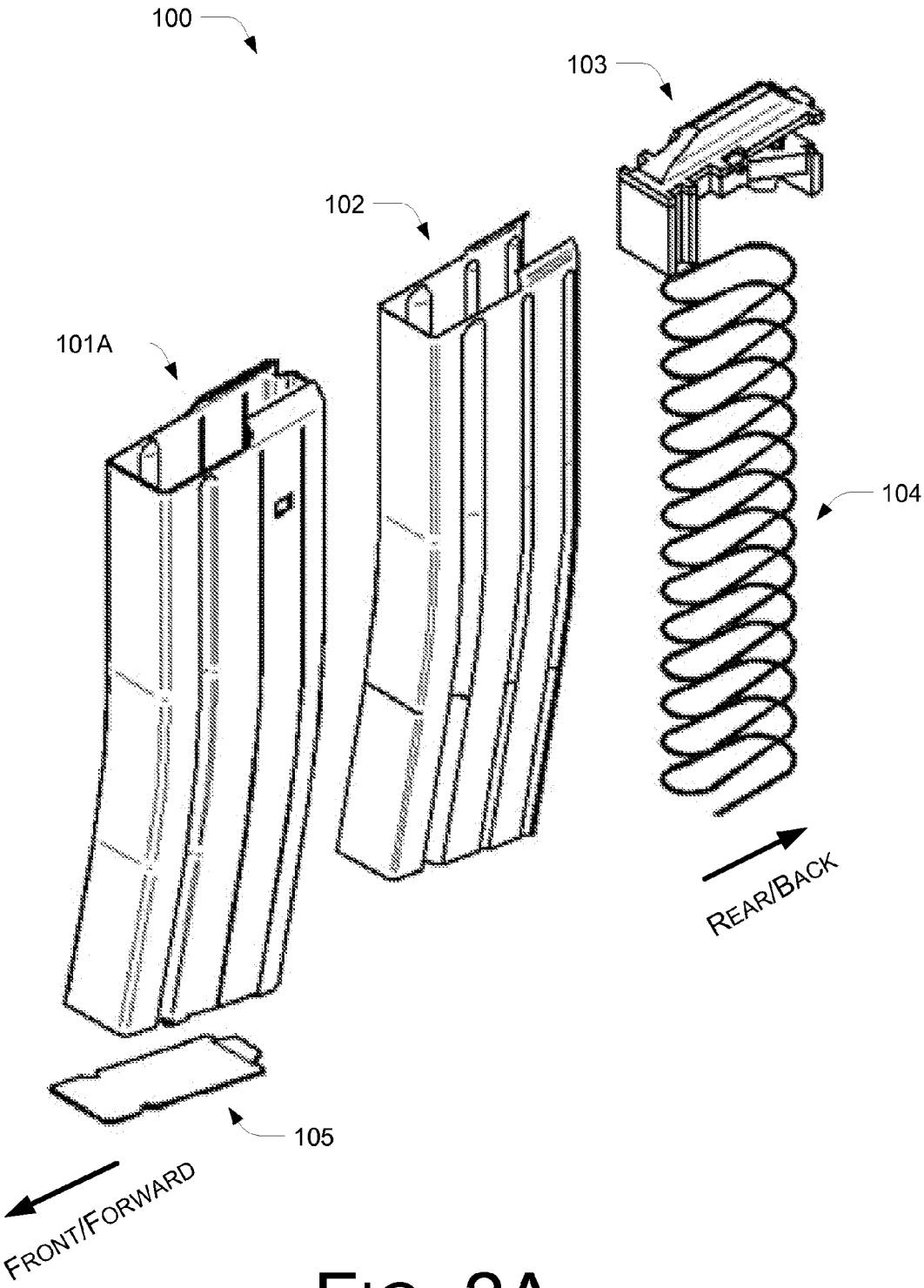
FIG. 2A is an exploded view of the universal magazine of FIG. 1 in accordance with an embodiment of the present disclosure.
Figure 2B:
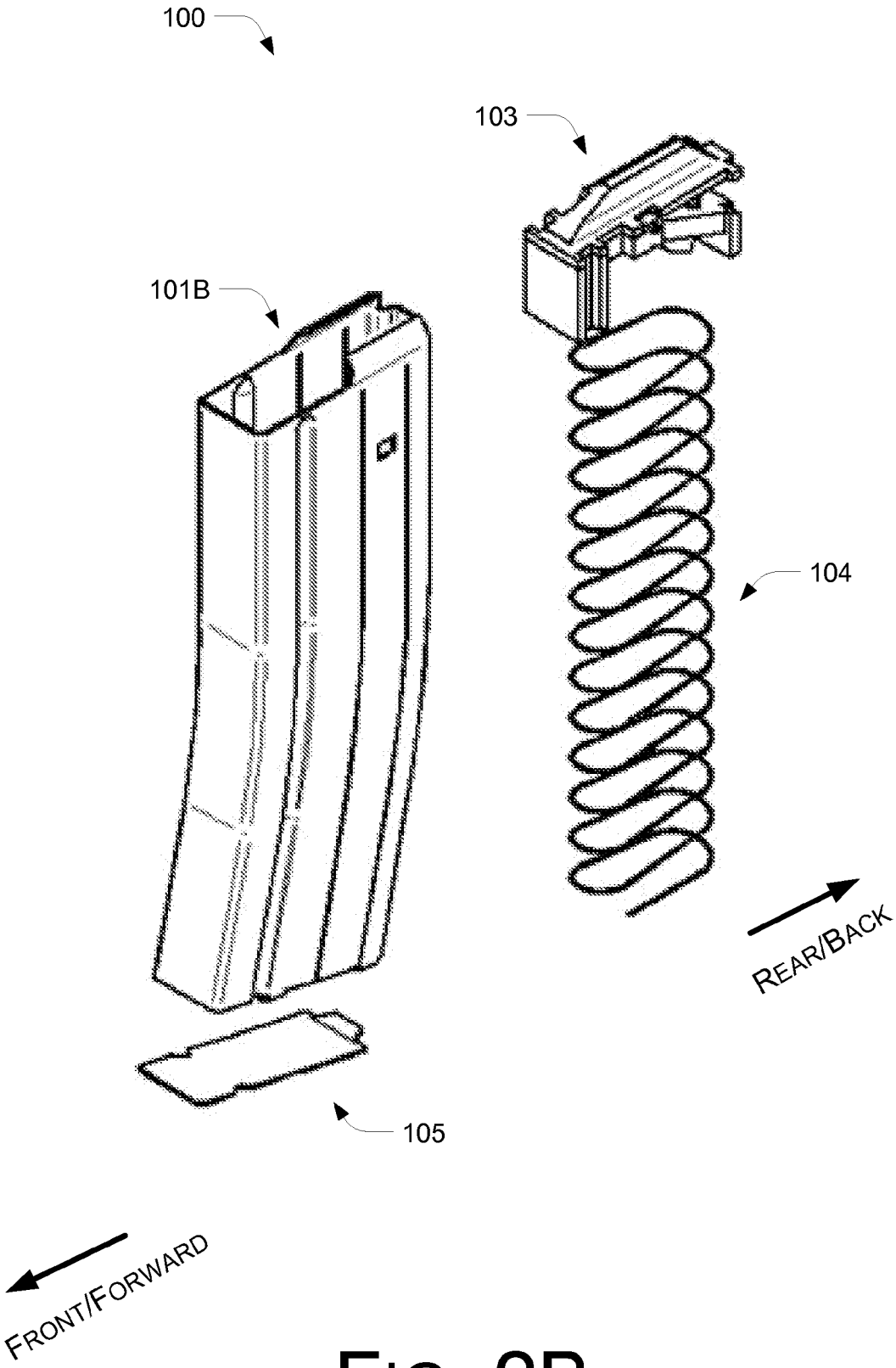
FIG. 2B is an exploded view of the universal magazine of FIG. 1 in accordance with another embodiment of the present disclosure.

FIG. 1 and FIGS. 2A, 2B illustrate a universal magazine 100 for a firearm in accordance with an embodiment of the present disclosure. Referring to FIG. 2B, the universal magazine 100 comprises a magazine shell 101B, a main magazine spring 104, and a tilt-able self-levering follower assembly 103. Optionally, referring to FIG. 2A, the universal magazine 100 may comprise a magazine shell 101A, the main magazine spring 104, the tilt-able self-levering follower assembly 103, and a self-adjusting deformable magazine sidewall spring 102. The design of the universal magazine 100 is aimed to reliably feed ammunition cartridges of various calibers, even with large tapering angle on the casing, to a firearm, such as the AR15 rifle for example, that has a straight magazine wall design. Those skilled in the art would appreciate that, although examples given in the present disclosure may refer to the AR15 rifle, embodiments described herein and variations thereof may be applied to other firearms having a straight magazine wall design. In other words, the scope of the present disclosure is not limited to applications in the AR15 rifle, and extends to other suitable firearms as well.

Detailed description of various embodiments of the tiltable self-levering follower assembly 103 is provided in copending U.S. application Ser. No. 13/731,037 and thus will not be provided herein in the interest of brevity.

For simplicity, both the magazine shell 101A and 101B are together referred to as the magazine shell 101 when common features are described. The magazine shell 101 includes a first end, a second end opposite the first end, and sidewalls between the first end and the second end. For example, the first end of the magazine shell 101 may be the end that is on the upper end of the magazine shell 101, as shown in FIGS. 1, 2A and 2B; and the second end of the magazine shell 101 may be the distal end that is on the lower end of the magazine shell 101, as shown in FIGS. 1, 2A and 2B. The first end of the magazine shell 101 has an opening and configured to attach to the firearm. Ammunition cartridges held in the universal magazine 100 are fed into the chamber of the firearm through the opening of the first end of the magazine shell 101. The second end of the magazine shell 101 may have an opening, and may include a bottom plate 105, as shown in FIGS. 2A and 2B, that encloses the universal magazine 100 on the second end of the magazine shell 101. In at least one implementation, the magazine shell 101 is of a straight-bent-straight design similar to that of a STANAG magazine. The magazine shell 101A shown in FIG. 2A may be similar to those of conventional design, while the magazine shell 101B shown in FIG. 2B is a new design in accordance with the present disclosure.

The main magazine spring 104 has a first end and a second end opposite the first end. When assembled, the second end of the main magazine spring 104 is coupled to the bottom plate 105 of the second end of the magazine shell 101, such as to an inner surface of the bottom plate 105 (or a hook thereon) for example. The main magazine spring 104 may be a compression spring, as shown in FIGS. 2A and 2B.

Example Embodiments of Magazine Shell

Figure 13:
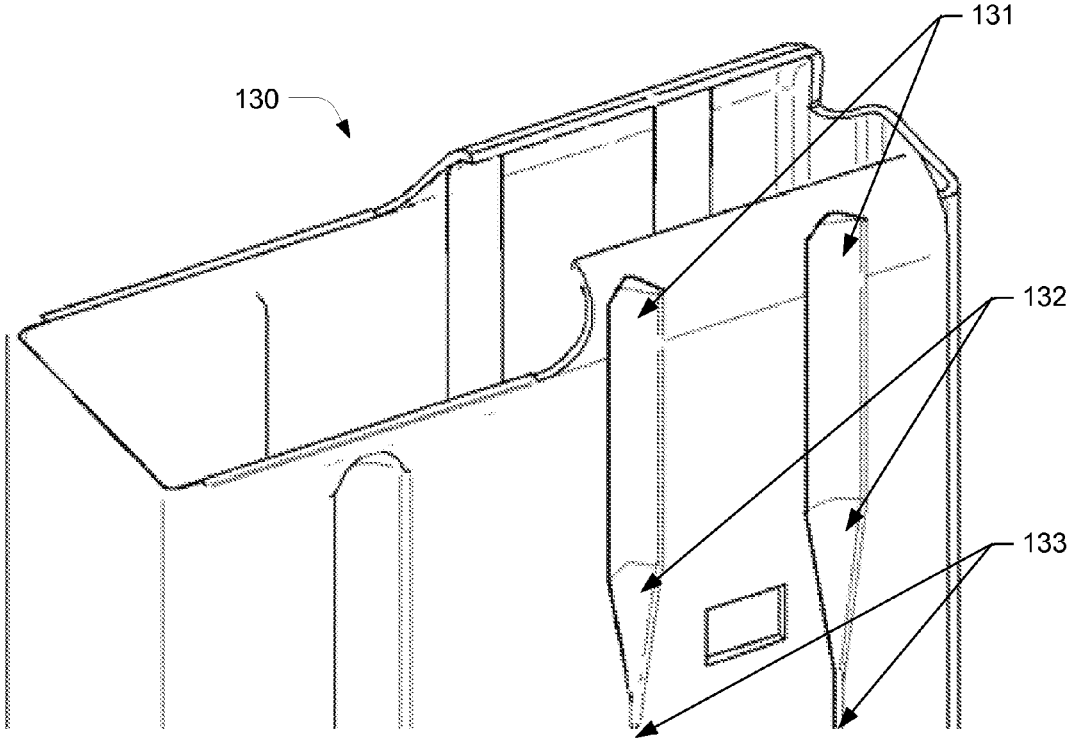
FIG. 13 is a perspective view of a magazine shell design without a magazine sidewall spring in accordance with an embodiment of the present disclosure.

FIG. 13 illustrates a magazine shell 130 without a magazine sidewall spring in accordance with an embodiment of the present disclosure. As shown in FIG. 2B, the universal magazine 100 may comprise a new magazine shell 101B that does not require a magazine sidewall spring, as with the magazine sidewall spring 102 shown in FIG. 2A. The magazine shell 130 shown in FIG. 13 may be implemented as magazine shell 101B in the universal magazine 100 of FIG. 2B.

Figure 3:
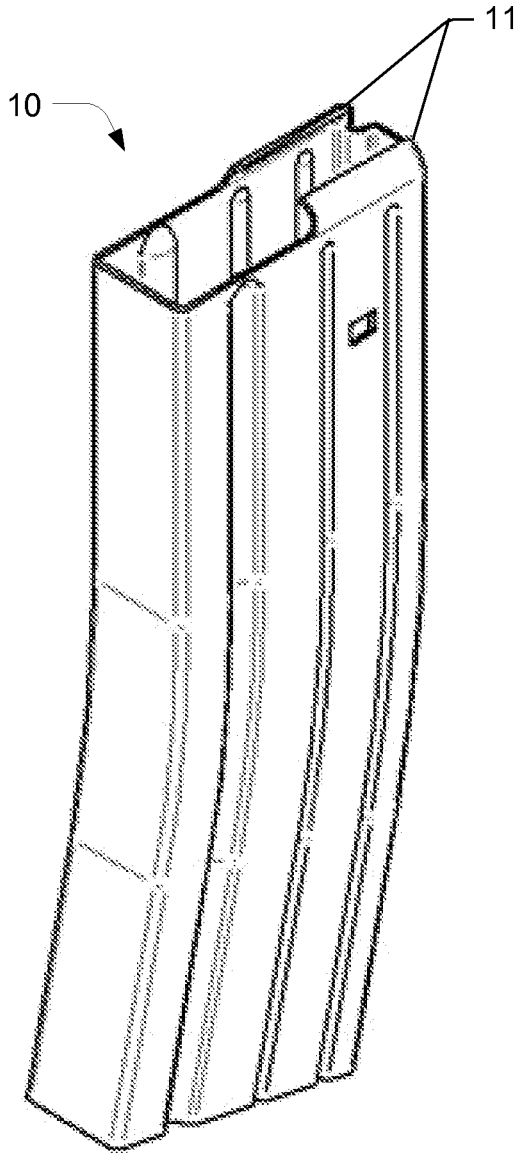
FIG. 3 (PRIOR ART)
FIG. 3 is a perspective view of a STANAG standard magazine.
Figure 4:
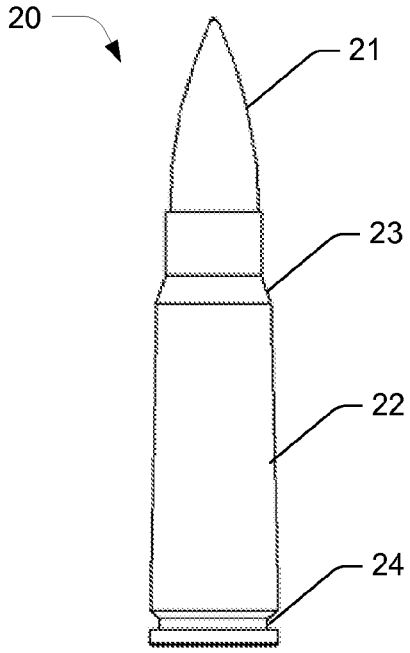
FIG. 4 (PRIOR ART)
FIG. 4 is a side view of an M43 ammunition cartridge.
Figure 5:
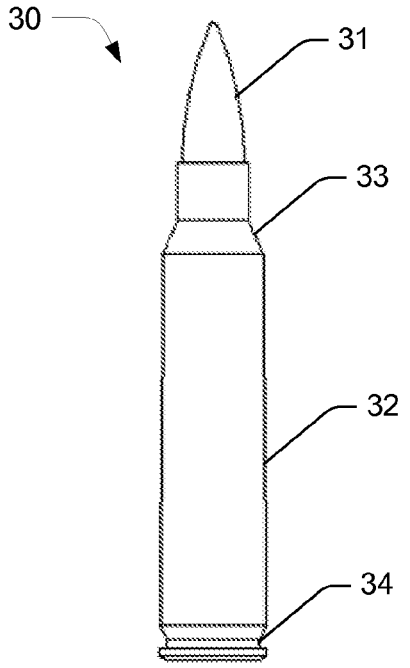
FIG. 5 (PRIOR ART)
FIG. 5 is a side view of a 223 Remington ammunition cartridge.
Figure 6:
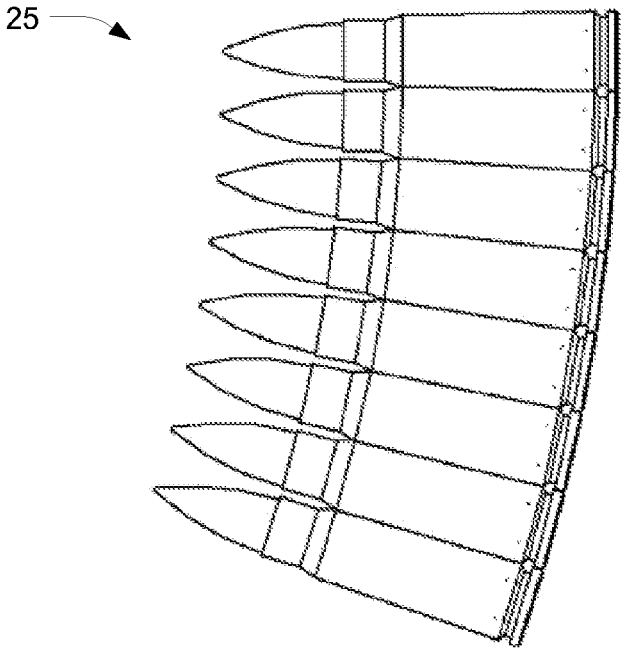
FIG. 6 (PRIOR ART)
FIG. 6 is a side view of a stack of M43 ammunition cartridges.
Figure 7:
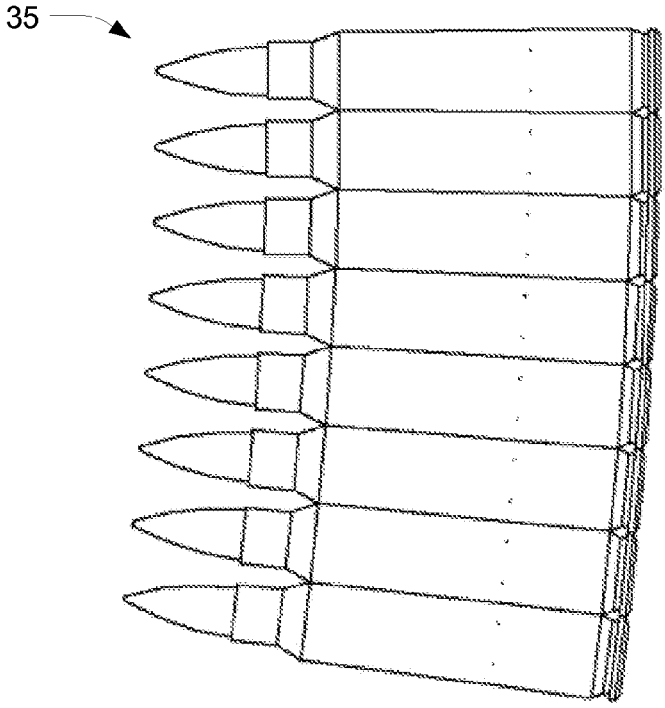
FIG. 7 (PRIOR ART)
FIG. 7 is a side view of a stack of 223 Remington ammunition cartridges.
Figure 8:
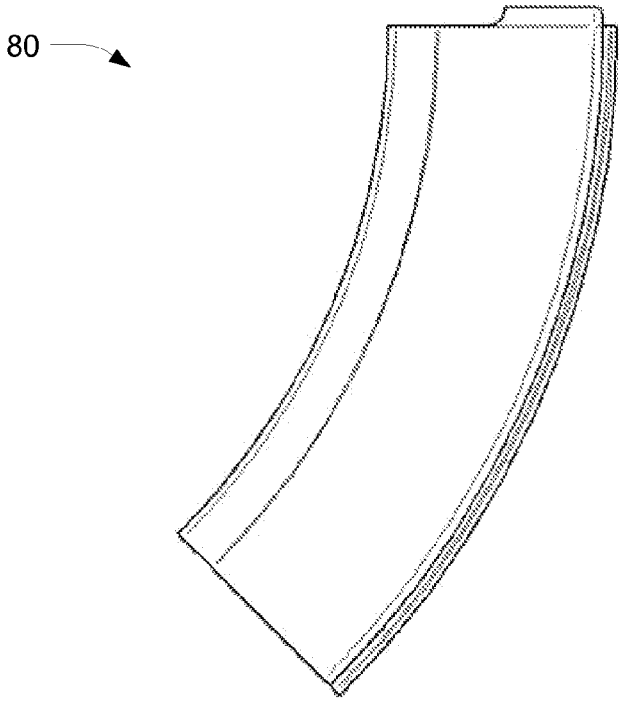
FIG. 8 (PRIOR ART)
FIG. 8 is a side view of an AK style magazine.
Figure 9:
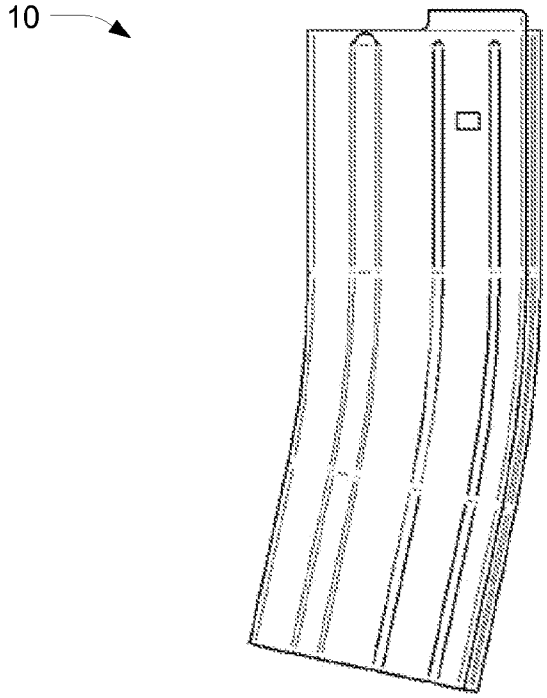
FIG. 9 (PRIOR ART)
FIG. 9 is a side view of a STANAG magazine

The magazine shell 130 may include at least one reinforcement groove oriented in a longitudinal direction along a length of the magazine shell 130. In the example shown in FIG. 13, the magazine shell 130 includes multiple reinforcement grooves, on the exterior of each of the two primary sides of the magazine shell 130, which are oriented in a longitudinal direction along a length of the magazine shell 130. Compared to a conventional magazine shell design shown in FIG. 3, the design of reinforcement grooves of the magazine shell 130 is modified. That is, the reinforcement grooves of the magazine shell 130 have different cross-sectional diameters in different sections. In the example shown in FIG. 13, the reinforcement grooves are divided into several sections, namely sections 131, 132 and 133. Section 131 of the reinforcement grooves is designed in such a way that the reinforcement grooves are deeper and have larger cross-sectional diameter in section 131 than in section 133. Section 132 is a transition section that connects sections 131 and 133, such that the interior of section 132 forms a ramp that changes the minimum distance between reinforcement grooves on the two opposite primary surfaces of the magazine shell 130 from large to small in a direction from bottom toward the top of the magazine shell 130.

Figure 14:
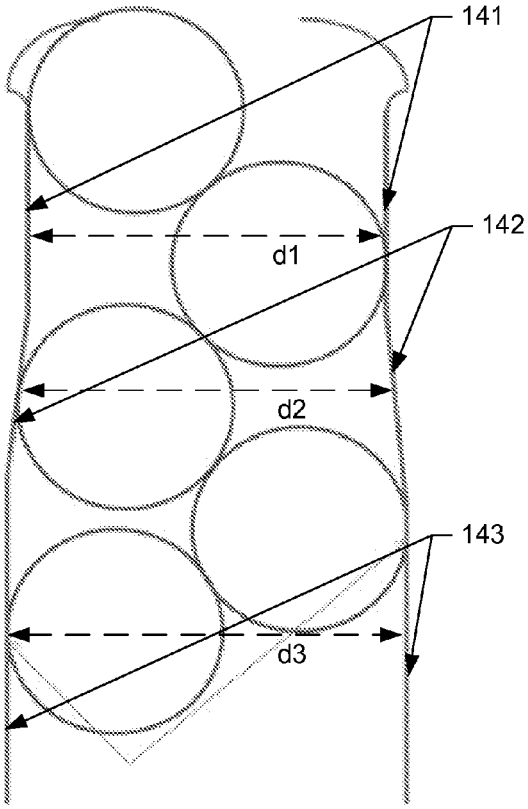
FIG. 14 is a cross-sectional view of an upper portion of the magazine shell design of FIG. 13 which is configured to hold ammunition cartridges of a relatively large rim diameter, viewing from rear to front of the magazine shell when in use with a firearm, in accordance with an embodiment of the present disclosure.
Figure 15:
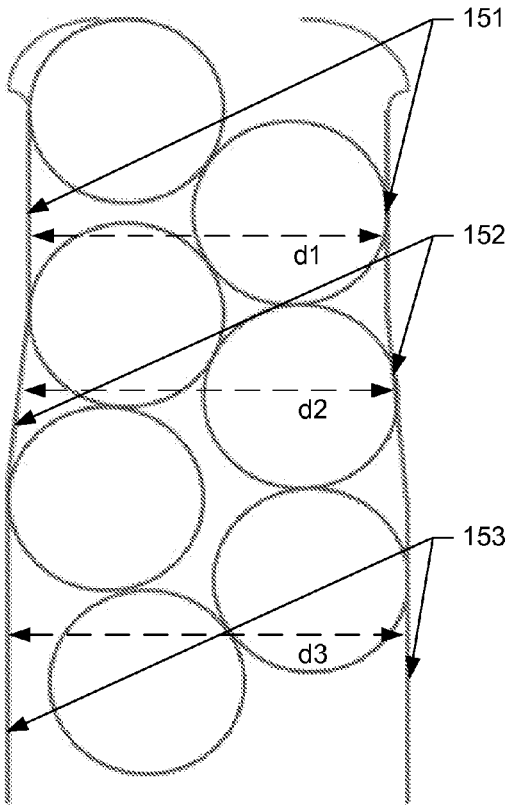
FIG. 15 is a cross-sectional view of an upper portion of the magazine shell design of FIG. 13 which is configured to hold ammunition cartridges of a smaller rim diameter, viewing from rear to front of the magazine shell when in use with a firearm, in accordance with an embodiment of the present disclosure.

FIG. 14 illustrates a cross-sectional view of an upper portion of the magazine shell design of FIG. 13 which is shown holding ammunition cartridges of a relatively large rim diameter, viewing from rear to front of the magazine shell when in use with a firearm, in accordance with an embodiment of the present disclosure. FIG. 15 illustrates a cross-sectional view of an upper portion of the magazine shell design of FIG. 13 (identical to that shown in FIG. 14) which is shown holding ammunition cartridges of a smaller rim diameter, viewing from rear to front of the magazine shell when in use with a firearm, in accordance with an embodiment of the present disclosure.

The position and alignment of the first two ammunition cartridges from the lip are the most important to ensure reliable feeding of all the ammunition cartridges held inside the magazine. As shown in FIGS. 14 and 15, looking from rear toward front, the design has a change in the width of the cross section from the bottom toward the top where the lip is located. Each of the lines 141, 142 and 143, as well as the lines 151, 152 and 153, depicts the valley (or bottom) of section 131, 132 or 133, respectively, of the reinforcement grooves of the magazine shell 130 shown in FIG. 13. In other words, the distance between the pair of lines 141 represent the minimum distance inside the magazine shell 130 at a height approximate section 131 of the reinforcement grooves. Likewise, the distance between the pair of lines 142 represent the minimum distance inside the magazine shell 130 at a height approximate section 132 of the reinforcement grooves. Similarly, the distance between the pair of lines 143 represent the minimum distance inside the magazine shell 130 at a height approximate section 133 of the reinforcement grooves. The same can be said with respect to the example shown in FIG. 15. With the designs shown in FIGS. 14 and 15, the distance d1 is smaller than the distance d2, which is smaller than the distance d3. Accordingly, with reinforcement grooves on a first primary side of the magazine shell 130 and a second primary side of the magazine shell 130 opposite to the first primary side, the cross-sectional distance between the inner surface of the first primary side and the inner surface of the second primary side generally decreases as viewed in a direction from the second end (e.g., bottom) toward the first end (e.g., top) of the magazine shell 130.

Figure 10:
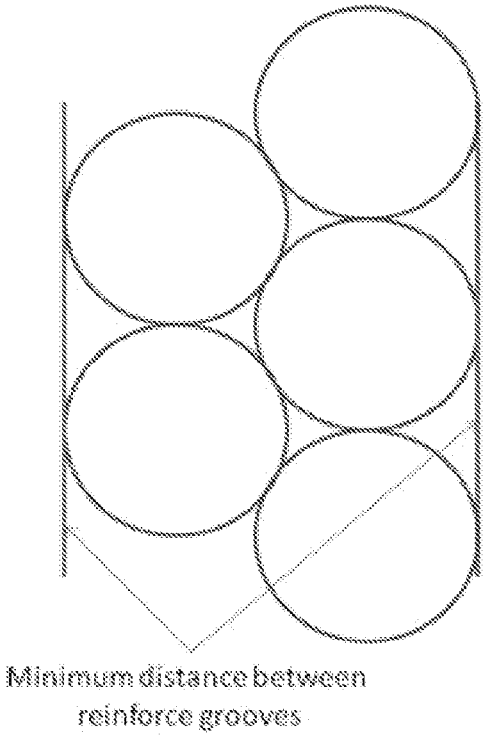
FIG. 10 is a cross-sectional view of a portion of a magazine shell configured to hold ammunition cartridges of a relatively large rim diameter, viewing from rear to front of the magazine shell when in use with a firearm, in accordance with an embodiment of the present disclosure.
Figure 11:
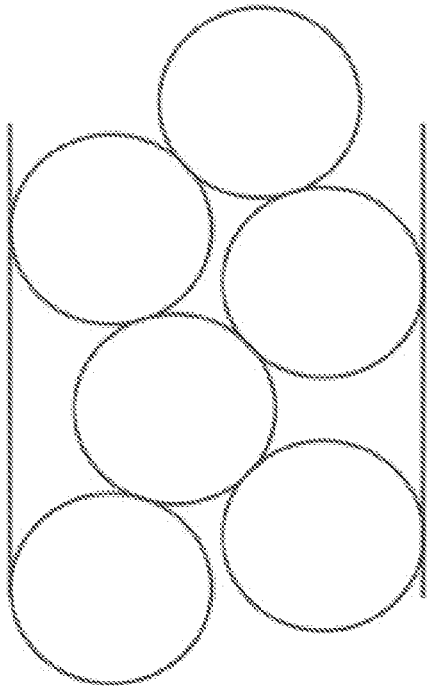
FIG. 11 is a cross-sectional view of a portion of a magazine shell configured to hold ammunition cartridges of a relatively large rim diameter while accommodating ammunition cartridges of a smaller rim diameter, viewing from rear to front of the magazine shell when in use with a firearm, in accordance with an embodiment of the present disclosure.
Figure 12:
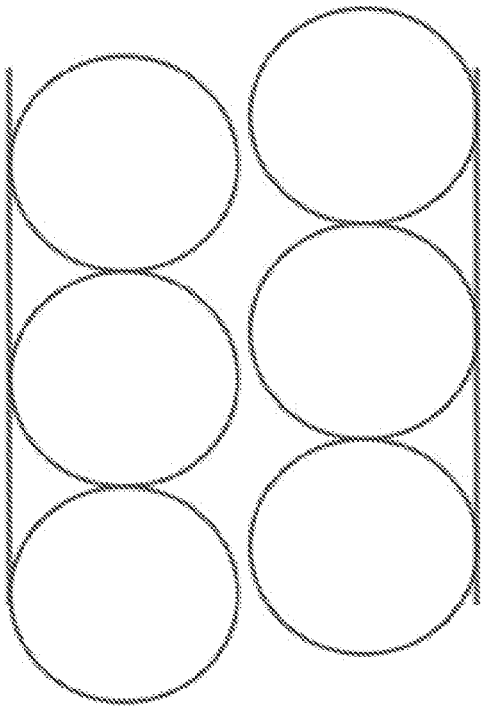
FIG. 12 is a cross-sectional view of a portion of a magazine shell configured to hold ammunition cartridges of a relatively large rim diameter while accommodating ammunition cartridges of a smaller rim diameter, viewing from rear to front of the magazine shell when in use with a firearm, in accordance with an embodiment of the present disclosure.

In one embodiment, as shown in FIGS. 14 and 15, close to the magazine lip on the top, the width of the cross section of the magazine shell 130 becomes smaller so that ammunition cartridges with smaller rim diameter can be stacked securely for at least the first two ammunition cartridges on the top of the stack of ammunition cartridges (e.g., as shown in FIG. 15). At the portion of the magazine shell 130 where the cross section is larger (e.g., between the two lines 143), ammunition cartridges with smaller rim diameter may be stacked in a less-stable manner; however, this would not affect the orientation of first two ammunition cartridges on the top of the stack of ammunition cartridges. Hence, reliable feeding of ammunition cartridges can still be achieved compared to the design described previously. As shown in FIG. 14, ammunition cartridges with larger rim diameter would be stacked less densely compared to those shown in FIG. 10, albeit still stacked stably. Therefore, the design in accordance with the present disclosure would feed ammunition cartridges with various rim diameters stably.

These and other objectives of the present disclosure will be appreciated by those of ordinary skill in the art after reading the following detailed description of the preferred embodiments that are illustrated in the various figures and drawings.

Example Embodiments of Magazine Sidewall Spring

Figure 16:
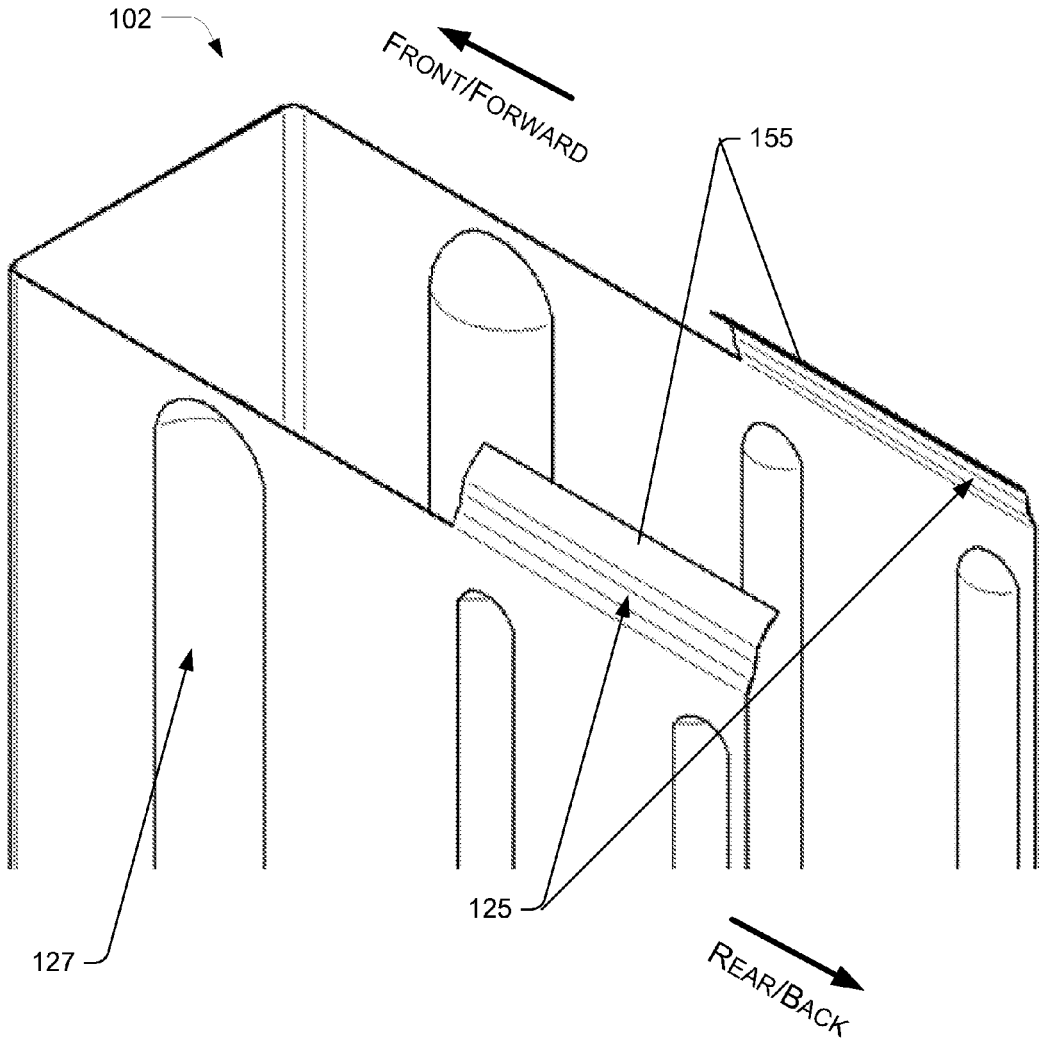
FIG. 16 is a perspective view of a self-adjusting magazine sidewall spring of a universal magazine in accordance with an embodiment of the present disclosure.
Figure 17:
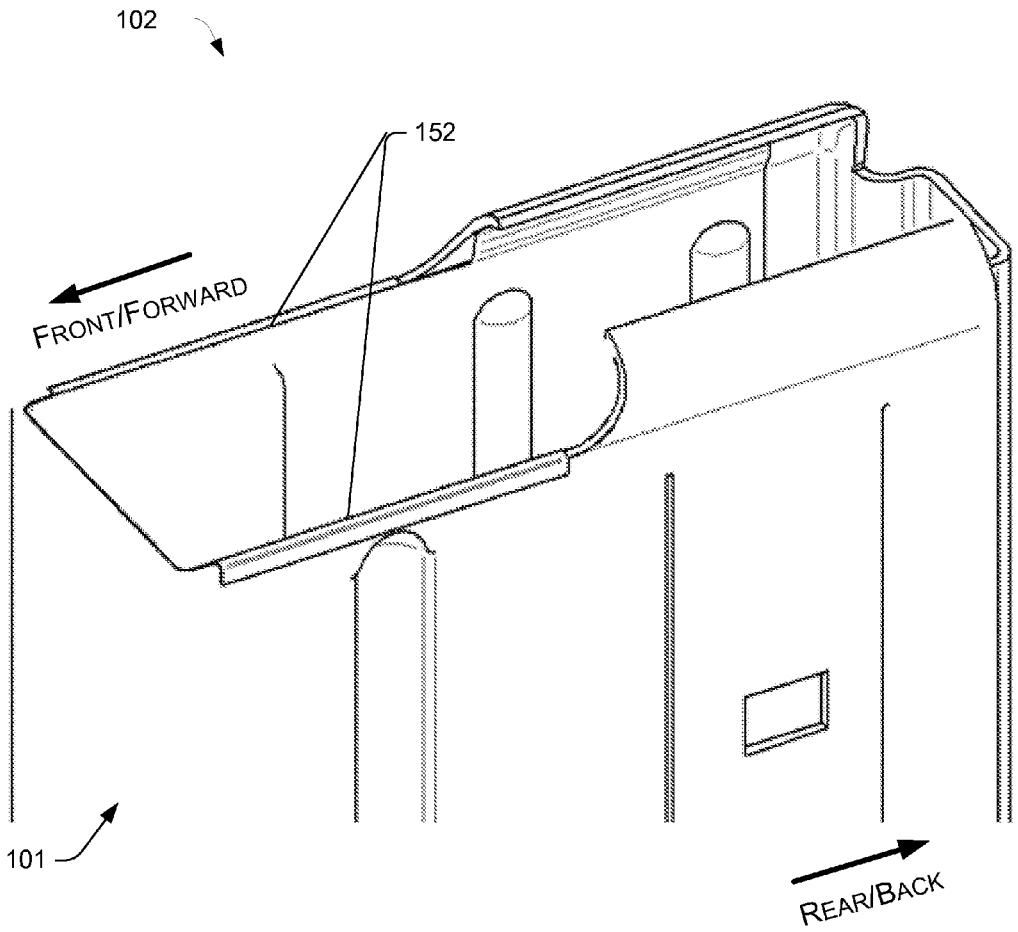
FIG. 17 is a perspective view of the self-adjusting magazine sidewall spring of FIG. 20 fitted inside a magazine shell of a universal magazine in accordance with an embodiment of the present disclosure.

FIG. 16 illustrates the self-adjusting magazine sidewall spring 102 of the universal magazine 100 in accordance with an embodiment of the present disclosure. FIG. 17 illustrates the self-adjusting magazine sidewall spring 102 of FIG. 16 fitted inside the magazine shell 101 of the universal magazine 100 in accordance with an embodiment of the present disclosure.

The self-adjusting deformable magazine sidewall spring 102 is received in the magazine shell 101 and fitted along an internal surface of the magazine shell 101. The deformable magazine sidewall spring 102 provides side support to one or more ammunition cartridges when the one or more ammunition cartridges are held in the magazine shell 101 and in contact with the deformable magazine sidewall spring 102. In particular, the deformable magazine sidewall spring 102 provides the side support by deforming and exerting a third force on the one or more ammunition cartridges in directions generally perpendicular to the sidewalls of the magazine shell 101.

In at least one implementation, the deformable magazine sidewall spring 102 comprises a thin sheet metal.

In at least one implementation, the deformable magazine sidewall spring 102 has an outer surface contoured to match an inner surface of the sidewalls of the magazine shell 101. For example, the sidewalls of the magazine shell 101 may include one or more reinforcement grooves. Correspondingly, the deformable magazine sidewall spring 102 may include a plurality of grooves 127 that correspond to and match the one or more reinforcement grooves of the magazine shell 101.

In at least one implementation, the deformable magazine sidewall spring 102 includes one or more protrusions 152 that extend outside the magazine shell 101 and contact an external surface of the magazine shell 101 when the deformable magazine sidewall spring 102 is received in the magazine shell 101. The one or more protrusions 152 advantageously reinforce the sealing between the deformable magazine sidewall spring 102 and the magazine shell 101.

In at least one implementation, the deformable magazine sidewall spring 102 includes one or more protrusions 155 that extend into a feeding lip of the magazine shell 101. Each of the one or more protrusions 155 forms one or more respective bump 125 a ridgeline of which is generally parallel with a ridgeline of the feeding lip of the magazine shell 101. The one or more bumps 125 advantageously provide guidance support to one or more ammunition cartridges of different calibers when the one or more ammunition cartridges are pushed out of the magazine shell 101 and into a firing chamber of the firearm by a bolt of the firearm.

As shown in FIGS. 16 and 17, on the top of the deformable magazine sidewall spring 102, the one or more grooves 127 gradually flatten out to leave no gap between the deformable magazine sidewall spring 102 and the inner surface of the magazine shell 101, so that dirt or debris would not come between them to cause malfunction. As shown in FIG. 17, the front portion of the deformable magazine sidewall spring 102 includes one or more protrusions 152 that extend outside of the magazine shell 101 and flap back to make contact with the external surface of the magazine shell 101 to make even better sealing with the magazine shell 101. This feature advantageously protects the portion of the deformable magazine sidewall spring 102 at the beginning of the one or more grooves 127 from cracking.

As shown in FIG. 16, the one or more protrusions 155 of the deformable magazine sidewall spring 102 extend into the magazine feeding lip area (not shown). The one or more grooves 125 are formed on the upper side location to provide guidance force (support) for ammunition cartridges, regardless of the caliber, when the firearm bolt (not shown) pushes the top ammunition cartridge out of the universal magazine 100 and into the firing chamber of the firearm. The rear side of the deformable magazine sidewall spring 102 may be open and there is a gap between the rear side of the deformable magazine sidewall spring 102 and the rear side of the magazine shell 101. This is necessary to allow the deformable magazine sidewall spring 102 to expand in the case that ammunition cartridges of large case diameters are used.

Figure 18:
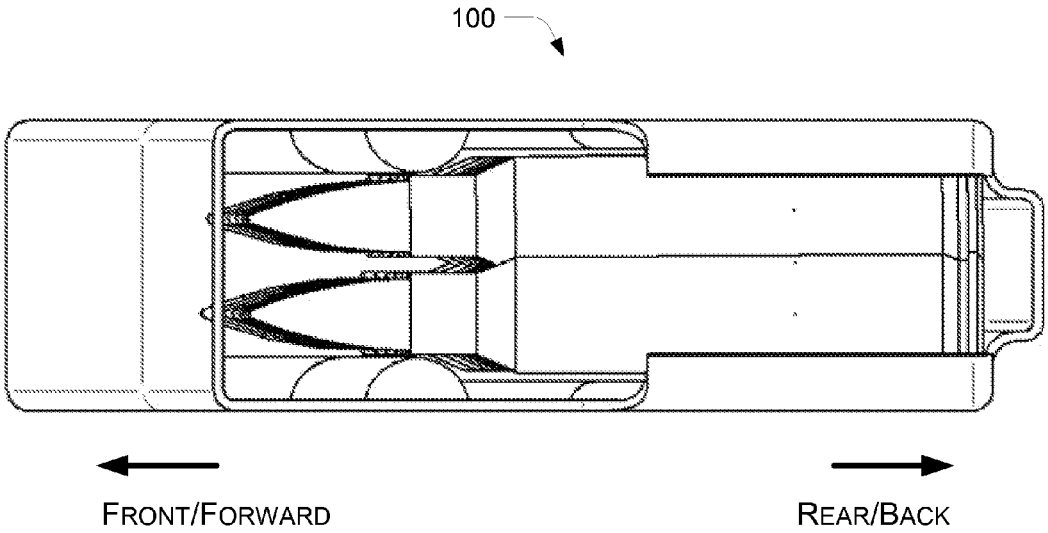
FIG. 18 is a top view of ammunition cartridges stacked inside a universal magazine in accordance with a further embodiment of the present disclosure.
Figure 19:
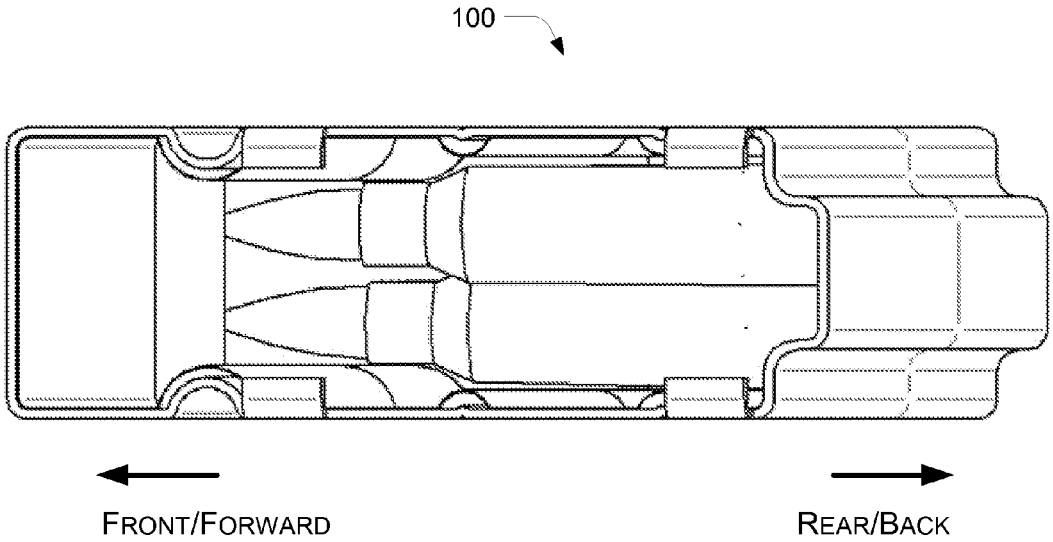
FIG. 19 is a bottom view of ammunition cartridges stacked inside a universal magazine in accordance with a further embodiment of the present disclosure.

FIG. 18 is a top view of ammunition cartridges stacked inside the universal magazine 100 in accordance with a further embodiment of the present disclosure. FIG. 19 is a bottom view of ammunition cartridges stacked inside the universal magazine 100 in accordance with a further embodiment of the present disclosure.

As shown in FIGS. 18 and 19, when ammunition cartridges are stacked inside the universal magazine 100, it is important to provide side support to the ammunition cartridges especially for double stackable cartridges. The internal width of the magazine shell 101 is designed to accommodate the largest casing diameter of the available calibers so the internal wall of the magazine shell 101, plus the pressed down deformable magazine sidewall spring 102, will provide such side support to the ammunition cartridges. However, when ammunition cartridges of smaller casing diameter are inserted in a conventional magazine, the sidewalls of the conventional magazine is not able to provide such side support. This is when the deformable magazine sidewall spring 102 comes into play. As shown in FIG. 2A, the deformable magazine sidewall spring 102 is stamped into a similar shape as that of the magazine shell 101, except the backside of the deformable magazine sidewall spring 102 is not enclosed as the magazine shell 101 is. The deformable magazine sidewall spring 102 is made by very thin sheet metal, and it has at least two grooves 127 on each side, one on the front, and one (two shown) on the back. These grooves 127 are deeper than their matching reinforcement grooves on the magazine shell 101. When installed inside of the magazine shell 101, the grooves 127 will deform as they are pressed by the stacked ammunition cartridges. The deformation of the grooves 127 is minimal for ammunition cartridges having the smallest casing diameter. The deformation of the grooves 127 is maximal for ammunition cartridges having the largest casing diameter. Accordingly, this feature advantageously provides side support for ammunition cartridges of all possible calibers.

Figure 20:
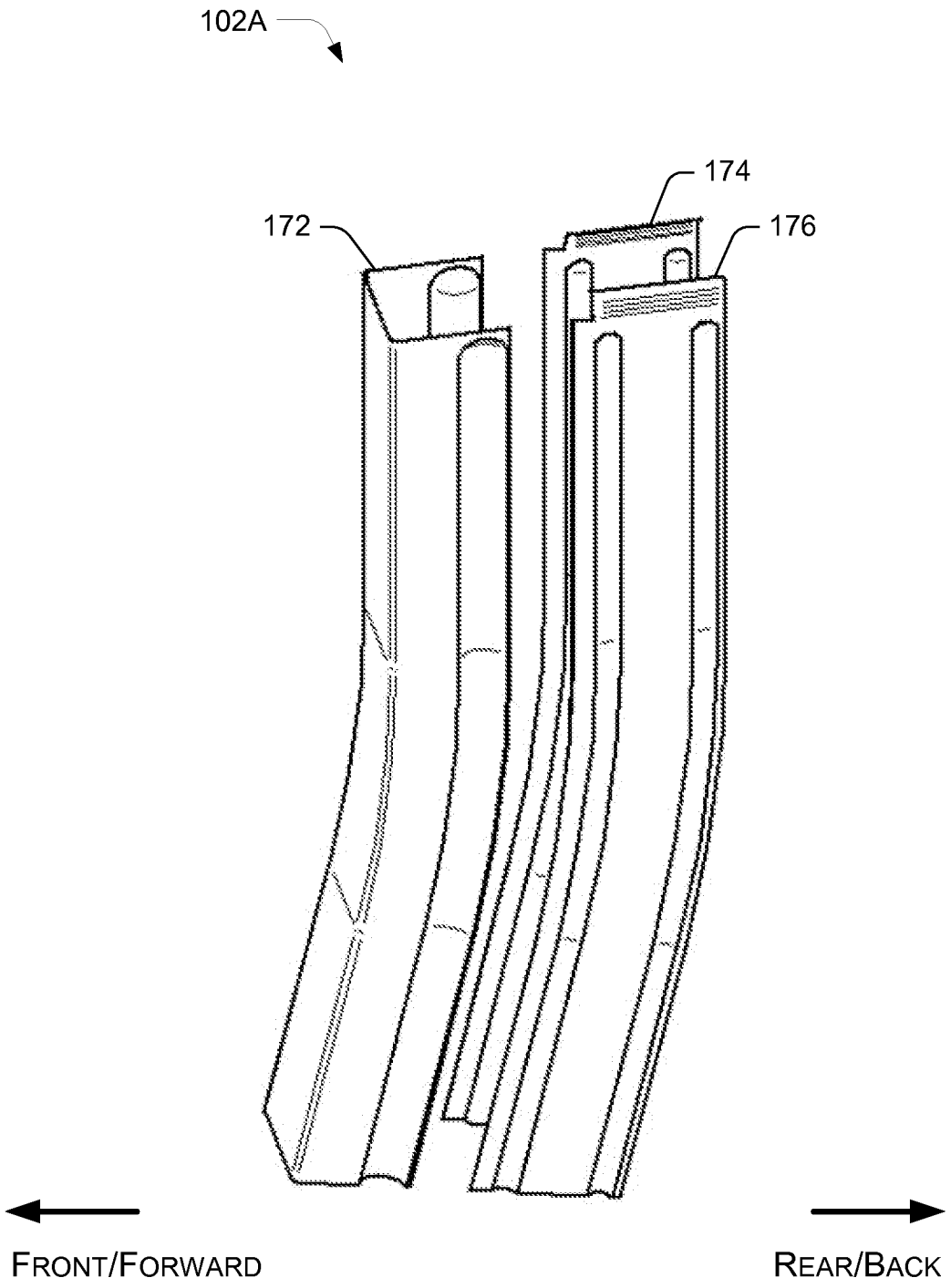
FIG. 20 is a perspective view of a self-adjusting magazine sidewall spring of a universal magazine in accordance with another embodiment of the present disclosure.

FIG. 20 illustrates another example of the self-adjusting magazine sidewall spring 102. Compared to the example shown in FIGS. 16 and 17, which features a one-piece design, the magazine sidewall spring 102*a* in the example depicted in FIG. 20 is a three-piece design including a front piece 172 and two side pieces 174 and 176. Each of the front piece 172 and the two side pieces 174 and 176 may be made of, for example, a thin sheet metal. Other than the difference just described, the example of the self-adjusting magazine sidewall spring 102A of FIG. 20 has the same features and functionality as those of FIGS. 16 and 17. Thus, in the interest of brevity, detailed description of the example of the self-adjusting magazine sidewall spring 102A of FIG. 20 will not be provided.

Figure 21:
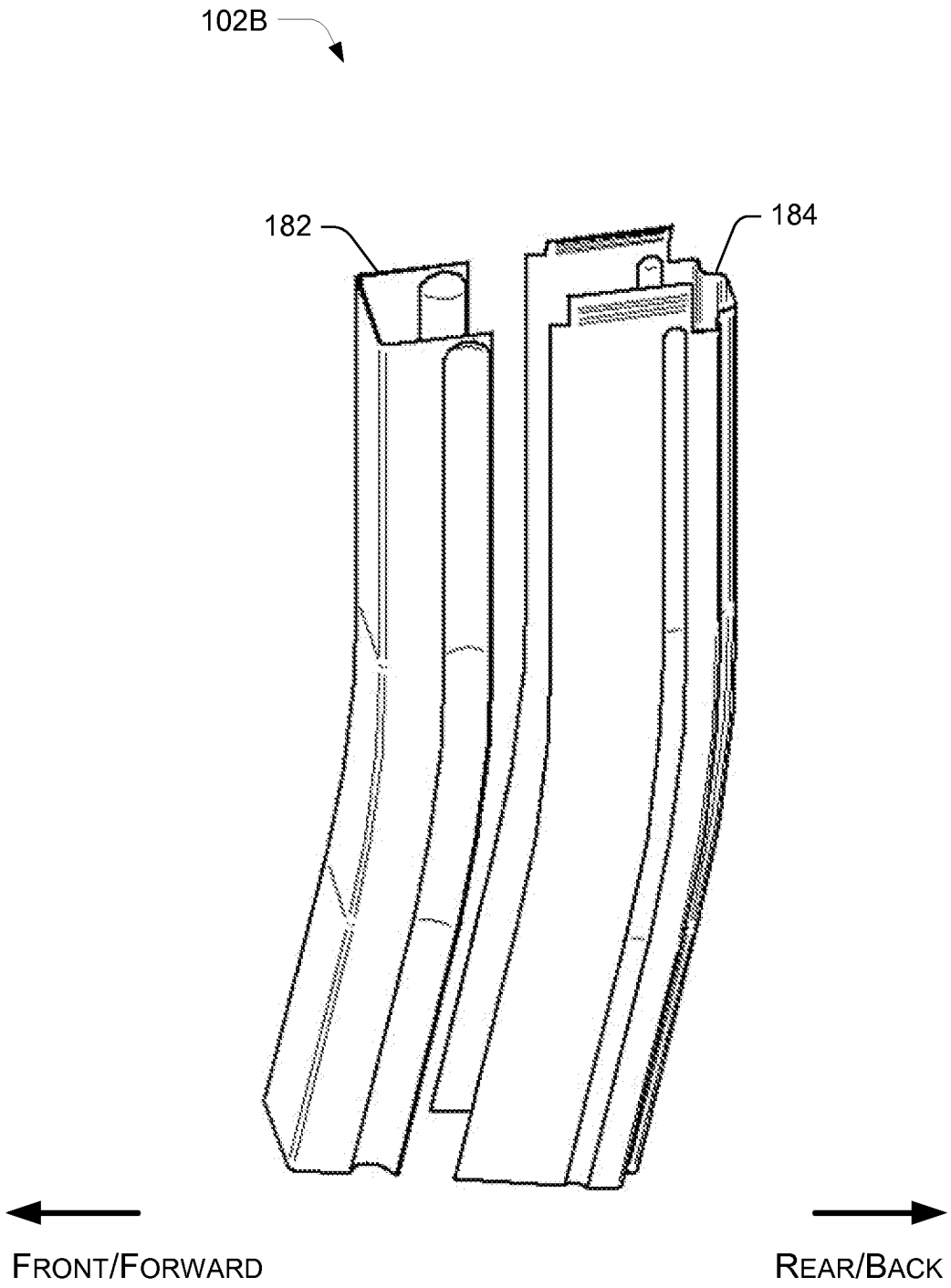
FIG. 21 is a perspective view of a self-adjusting magazine sidewall spring of a universal magazine in accordance with a further embodiment of the present disclosure.

FIG. 21 illustrates a further example of the self-adjusting magazine sidewall spring 102. In comparison with the example shown in FIGS. 16 and 17 and the example shown in FIG. 20, the magazine sidewall spring 102B in the example depicted in FIG. 21 is a two-piece design including a front piece 182 and a rear piece 184. Each of the front piece 182 and the rear piece 184 may be made of, for example, a thin sheet metal. Other than the difference just described, the example of the self-adjusting magazine sidewall spring 102B of FIG. 21 has the same features and functionality as those of FIGS. 16 and 17. Thus, in the interest of brevity, detailed description of the example of the self-adjusting magazine sidewall spring 102B of FIG. 21 will not be provided.

Figure 22:
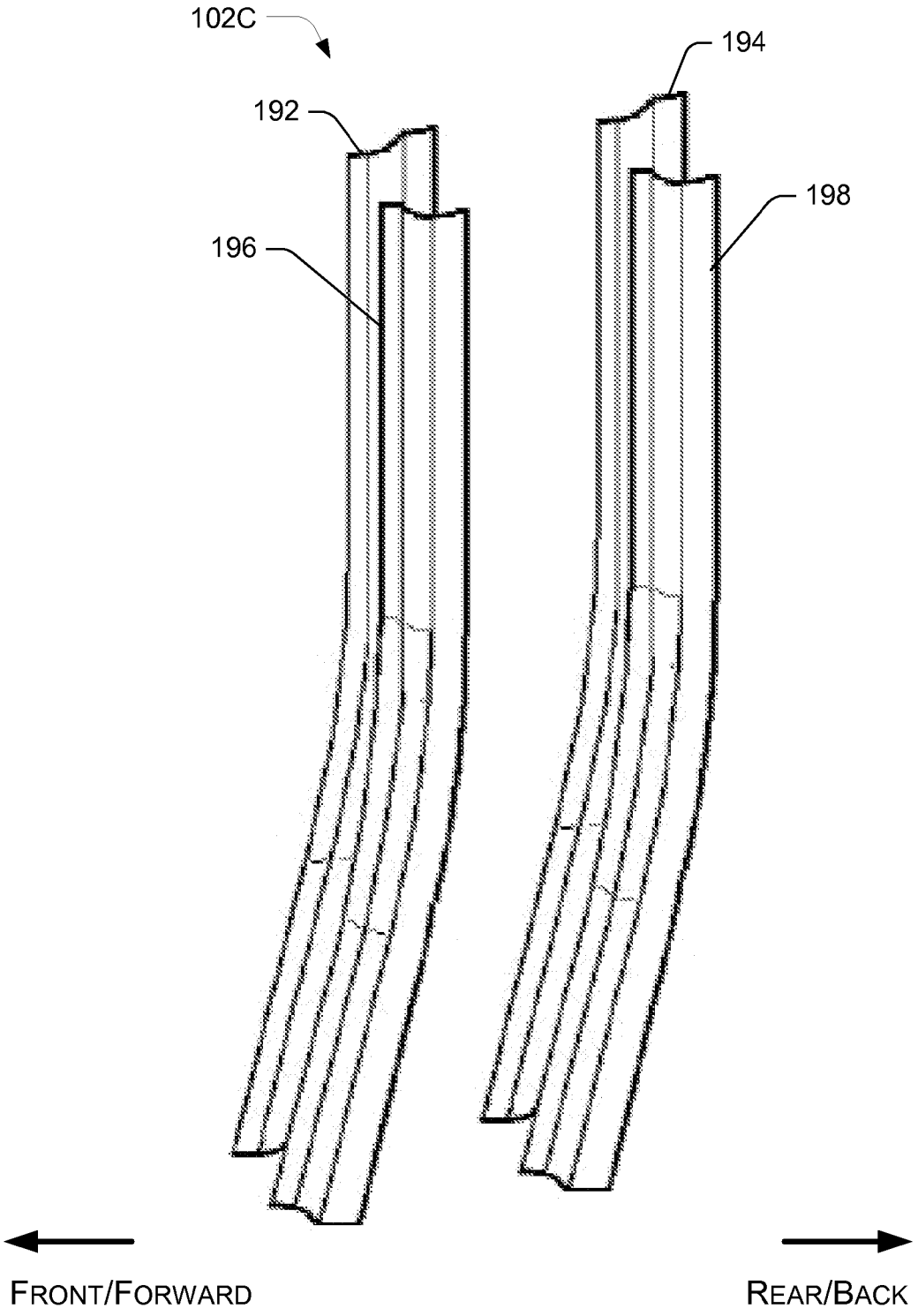
FIG. 22 is a perspective view of a self-adjusting magazine sidewall spring of a universal magazine in accordance with yet another embodiment of the present disclosure.

FIG. 22 illustrates yet another example of the self-adjusting magazine sidewall spring 102. In comparison with the example shown in FIGS. 16 and 17 and the example shown in FIGS. 20 and 21, the magazine sidewall spring 102C in the example depicted in FIG. 22 is a two-leaf-springs-in-two-rows design, including a first front half piece 192, a second front half piece 196, a first rear half piece 194, and a second rear half piece 198. Each of the front half pieces 192, 196 and the rear half pieces 194, 198 may be made of, for example, a thin sheet metal. Other than the difference just described, the example of the self-adjusting magazine sidewall spring 102C of FIG. 22 has the same features and functionality as those of FIGS. 16 and 17. Thus, in the interest of brevity, detailed description of the example of the self-adjusting magazine sidewall spring 102C of FIG. 22 will not be provided.

In short, in various embodiments, different designs of the self-adjusting sidewall spring, such as those shown in FIGS. 16, 17, 20, 21 and 22, may be used in combination with the magazine shell design shown in FIG. 13.

CONCLUSION

It will be apparent to those skilled in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims and their equivalents.

What is claimed is:

1. A magazine for a firearm, comprising:

a magazine shell having a first end, a second end opposite the first end, and a plurality of sidewalls between the first end and the second end, the first end having an opening and configured to attach to the firearm, the second end including a bottom plate;

a main magazine spring having a first end and a second end opposite the first end, the second end of the main magazine spring coupled to the bottom plate of the second end of the magazine shell; and a deformable magazine sidewall spring received in the magazine shell and fitted along an internal surface of the magazine shell such that the deformable magazine sidewall spring provides side support to one or more ammunition cartridges when the one or more ammunition cartridges are held in the magazine shell and in contact with the deformable magazine sidewall spring by deforming and exerting a first force on the one or more ammunition cartridges in directions generally perpendicular to the sidewalls of the magazine shell, wherein the magazine shell includes at least one feeding lip extending, with a curvature, from at least one of the plurality of sidewalls at the first end of the magazine shell, wherein the magazine shell further includes at least one reinforcement groove that extends longitudinally into the curvature of the at least one feeding lip, wherein the deformable magazine sidewall spring has an outer surface contour similar to that of an inner surface of the sidewalls of the magazine shell, and wherein the sidewalls of the magazine shell includes one or more reinforcement grooves, and wherein the deformable magazine sidewall spring includes one or more grooves corresponding to the one or more reinforcement grooves of the magazine shell, the one or more grooves of the deformable magazine sidewall spring providing side support to one or more ammunition cartridges when the one or more ammunition cartridges are held in the magazine shell.

2. The magazine of claim 1, wherein the at least one reinforcement groove includes a plurality of sections thereof, wherein a cross-sectional diameter of a first section of the plurality of sections of the at least one reinforcement groove is different from a cross-sectional diameter of a second section of the plurality of sections of the at least one reinforcement groove.

3. The magazine of claim 2, wherein the magazine shell includes a first reinforcement groove of the at least one reinforcement groove on a first primary side of the magazine shell, wherein the magazine shell further includes a second reinforcement groove of the at least one reinforcement groove on a second primary side of the magazine shell opposite to the first primary side, and wherein variations in the cross-sectional diameter of each of the first and the second reinforcement grooves render a distance between an inner surface of the first primary side and an inner surface of the second primary side to generally decrease as viewed in a direction from the second end toward the first end of the magazine shell.

4. The magazine of claim 1, wherein the deformable magazine sidewall spring comprises a thin sheet metal.

5. The magazine of claim 1, wherein the deformable magazine sidewall spring includes a protrusion that extends outside the magazine shell and contacts an external surface of the magazine shell when the deformable magazine sidewall spring is received in the magazine shell, the protrusion reinforcing sealing between the deformable magazine sidewall spring and the magazine shell.

6. The magazine of claim 1, wherein the deformable magazine sidewall spring includes a protrusion that extends into the at least one feeding lip of the magazine shell and forms a bump of which is generally parallel with a ridgeline of the at least one feeding lip of the magazine shell, the bump providing guidance support to one or more ammunition cartridges of different calibers when the one or more ammunition cartridges are pushed out of the magazine shell and into a firing chamber of the firearm by a bolt of the firearm.

7. A magazine for a firearm, comprising:

a magazine shell having a first end, a second end opposite the first end, and a plurality of sidewalls between the first end and the second end, the first end having an opening and configured to attach to the firearm, the second end including a bottom plate;

a main magazine spring having a first end and a second end opposite the first end, the second end of the main magazine spring coupled to the bottom plate of the second end of the magazine shell; and a deformable magazine sidewall spring received in the magazine shell and fitted along an internal surface of the magazine shell such that the deformable magazine sidewall spring provides side support to one or more ammunition cartridges when the one or more ammunition cartridges are held in the magazine shell and in contact with the deformable magazine sidewall spring by deforming and exerting a first force on the one or more ammunition cartridges in directions generally perpendicular to the sidewalls of the magazine shell, wherein the magazine shell includes at least one feeding lip extending, with a curvature, from at least one of the plurality of sidewalls at the first end of the magazine shell, wherein the magazine shell further includes at least one reinforcement groove that extends longitudinally into the curvature of the at least one feeding lip, wherein the deformable magazine sidewall spring has an outer surface contour similar to that of an inner surface of the sidewalls of the magazine shell, wherein the at least one reinforcement groove includes a plurality of sections thereof, wherein a cross-sectional diameter of a first section of the plurality of sections of the at least one reinforcement groove is different from a cross-sectional diameter of a second section of the plurality of sections of the at least one reinforcement groove, and wherein the deformable magazine sidewall spring includes at least one groove corresponding to the at least one reinforcement groove of the magazine shell, wherein the at least one groove of the deformable magazine sidewall spring provides side support to one or more ammunition cartridges when the one or more ammunition cartridges are held in the magazine shell.

8. The magazine of claim 7, wherein the deformable magazine sidewall spring comprises a thin sheet metal.

9. The magazine of claim 7, wherein the magazine shell includes a first reinforcement groove of the at least one reinforcement groove on a first primary side of the magazine shell, wherein the magazine shell further includes a second reinforcement groove of the at least one reinforcement groove on a second primary side of the magazine shell opposite to the first primary side, and wherein variations in the cross-sectional diameter of each of the first and the second reinforcement grooves render a distance between an inner surface of the first primary side and an inner surface of the second primary side to generally decrease as viewed in a direction from the second end toward the first end of the magazine shell.

10. The magazine of claim 7, wherein the deformable magazine sidewall spring includes a protrusion that extends outside the magazine shell and contacts an external surface of the magazine shell when the deformable magazine sidewall spring is received in the magazine shell, the protrusion reinforcing sealing between the deformable magazine sidewall spring and the magazine shell.

11. The magazine of claim 7, wherein the deformable magazine sidewall spring includes a protrusion that extends into the at least one feeding lip of the magazine shell and forms a bump of which is generally parallel with a ridgeline of the at least one feeding lip of the magazine shell, the bump providing guidance support to one or more ammunition cartridges with different calibers when the one or more ammunition cartridges are pushed out of the magazine shell and into a firing chamber of the firearm by a bolt of the firearm.

12. The magazine of claim 1, wherein the at least one feeding lip comprises two feeding lips protruding from two opposing sidewalls of the plurality of sidewalls at the first end of the magazine shell, wherein the at least one reinforcement groove comprises two or more reinforcement grooves each of which extending longitudinally into a curvature of a respective one of the two feeding lips, and wherein, when the magazine shell is fully loaded with a plurality of ammunition cartridges, either but not both of the two feeding lips is in contact with a top ammunition cartridge of the plurality of ammunition cartridges.

13. The magazine of claim 7, wherein the at least one feeding lip comprises two feeding lips protruding from two opposing sidewalls of the plurality of sidewalls at the first end of the magazine shell, wherein the at least one reinforcement groove comprises two or more reinforcement grooves each of which extending longitudinally into a curvature of a respective one of the two feeding lips, and wherein, when the magazine shell is fully loaded with a plurality of ammunition cartridges, either but not both of the two feeding lips is in contact with a top ammunition cartridge of the plurality of ammunition cartridges.

* * * * *